US006220346B1

(12) United States Patent
Gissler

(10) Patent No.: US 6,220,346 B1
(45) Date of Patent: Apr. 24, 2001

(54) THERMAL INSULATION VESSEL

(75) Inventor: Robert W. Gissler, Spring, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/322,900

(22) Filed: May 29, 1999

(51) Int. Cl.[7] ..... E21B 36/00
(52) U.S. Cl. ..... 166/57; 166/66.5
(58) Field of Search ..... 248/206.5, 309.4; 166/66.5, 57

(56) References Cited

U.S. PATENT DOCUMENTS

| | | | | |
|---|---|---|---|---|
| 2,924,432 | | 2/1960 | Arps et al. | 255/1 |
| 3,233,674 | | 2/1966 | Leutwyler | 166/63 |
| 3,351,224 | | 11/1967 | Anderson | 220/15 |
| 3,490,150 | | 1/1970 | Whitfill, Jr. | 33/133 |
| 3,497,958 | | 3/1970 | Gollwitzer | 33/133 |
| 3,514,006 | | 5/1970 | Molnar | 220/14 |
| 3,552,025 | | 1/1971 | Whitfill, Jr. | 33/133 |
| 3,570,594 | | 3/1971 | Hamilton | 166/64 |
| 3,597,022 | * | 8/1971 | Waldron | 308/10 |
| 3,730,374 | | 5/1973 | Picciano et al. | 220/9 |
| 3,847,208 | | 11/1974 | Ollendorf | 165/1 |
| 3,896,667 | | 7/1975 | Jeter | 73/151 |
| 4,129,184 | | 12/1978 | Parker | 166/315 |
| 4,248,298 | | 2/1981 | Lamers et al. | 166/57 |
| 4,265,110 | | 5/1981 | Moulin | 73/151 |
| 4,440,219 | | 4/1984 | Engelder | 166/57 |
| 4,872,507 | | 10/1989 | Ronco, Sr. et al. | 166/57 |
| 4,876,450 | | 10/1989 | Montgomery | 250/261 |
| 4,903,245 | | 2/1990 | Close et al. | 367/81 |
| 5,050,675 | | 9/1991 | Upchurch | 166/250 |
| 5,159,219 | * | 10/1992 | Chu et al. | 310/90.5 |
| 5,177,387 | * | 1/1993 | McMichael et al. | 310/90.5 |
| 5,217,075 | | 6/1993 | Wittrisch | 166/302 |
| 5,251,688 | | 10/1993 | Schatz | 165/10 |
| 5,361,838 | | 11/1994 | Kilgore | 166/255 |
| 5,404,016 | | 4/1995 | Boyd et al. | 250/352 |
| 5,412,568 | | 5/1995 | Schultz | 364/422 |
| 5,429,190 | | 7/1995 | Kilgore et al. | 166/255 |
| 5,456,316 | | 10/1995 | Owens et al. | 166/250.01 |
| 5,494,105 | | 2/1996 | Morris | 166/255.1 |
| 5,547,028 | | 8/1996 | Owens et al. | 166/302 |
| 5,647,435 | | 7/1997 | Owens et al. | 166/250.01 |
| 5,720,342 | | 2/1998 | Owens et al. | 166/57 |
| 5,730,217 | | 3/1998 | Owens et al. | 166/57 |

FOREIGN PATENT DOCUMENTS

| | | |
|---|---|---|
| 3537832A1 | 4/1987 | (DE) . |
| 2720475A1 | 12/1995 | (FR) . |
| 2025029 | 1/1980 | (GB) . |

OTHER PUBLICATIONS

Aug. 24, 2000 PCT International Search Report PCT/US00/14026.

* cited by examiner

*Primary Examiner*—William Neuder
(74) *Attorney, Agent, or Firm*—Paul I. Herman; J. Richard Konneker

(57) ABSTRACT

A thermal insulation vessel is provided that includes a first housing has a first internal cavity and an inner wall. A first plurality of magnets are coupled to the first housing and positioned proximate the inner wall in circumferentially spaced-apart relation. A second housing is positioned in the first internal cavity and has a second internal cavity and an outer wall. A second plurality of magnets is coupled to the second housing and positioned proximate the outer wall in circumferentially spaced-apart relation. The second plurality of magnets interacts with the first plurality of magnets to maintain a gap between the inner wall and the outer wall. The vessel may be used to thermally isolate components within or for use with various downhole tools. Magnetic levitation eliminates most and possibly all pathways for conductive heat transfer.

57 Claims, 12 Drawing Sheets

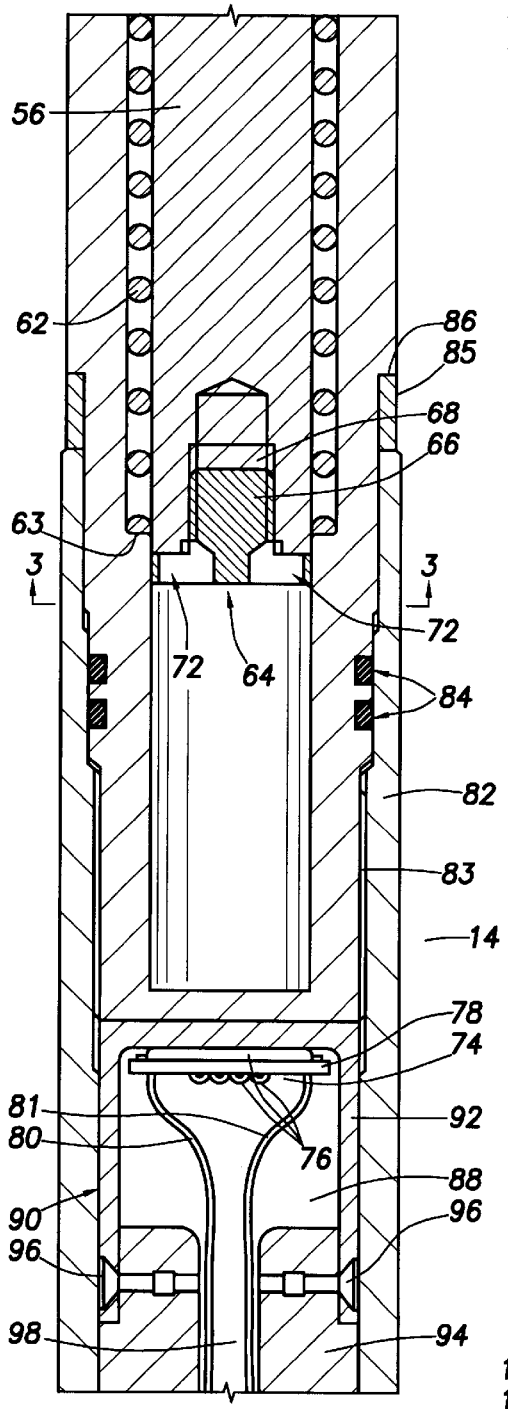
FIG.2B
FIG.2C
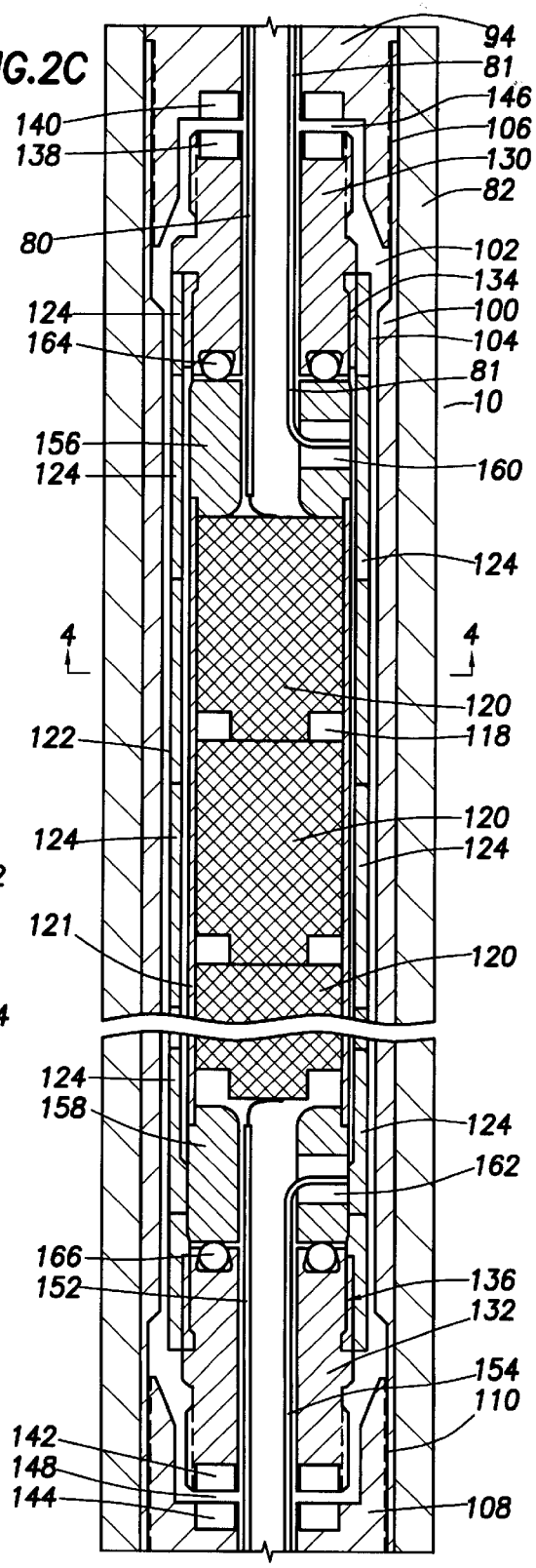

FIG.4
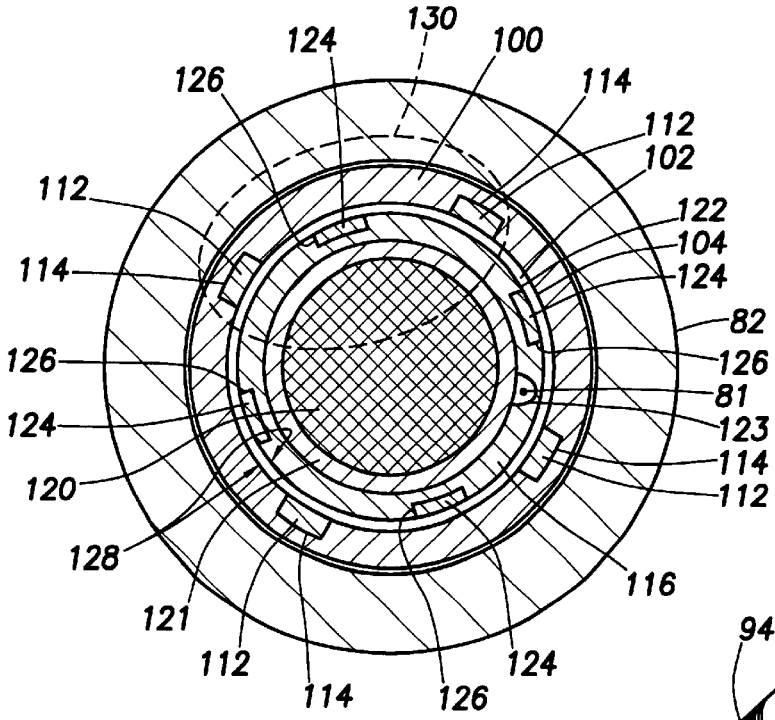
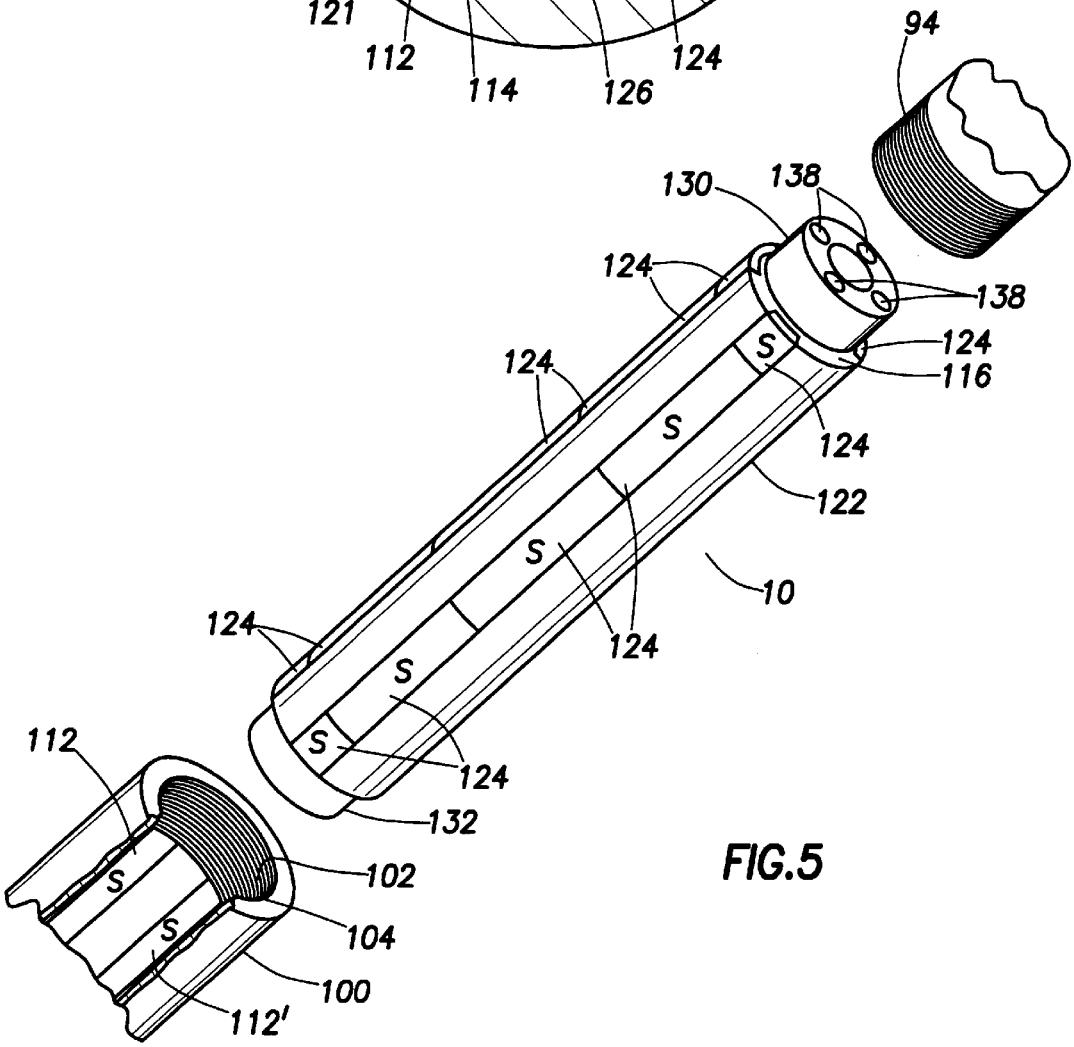
FIG.5

FIG. 10
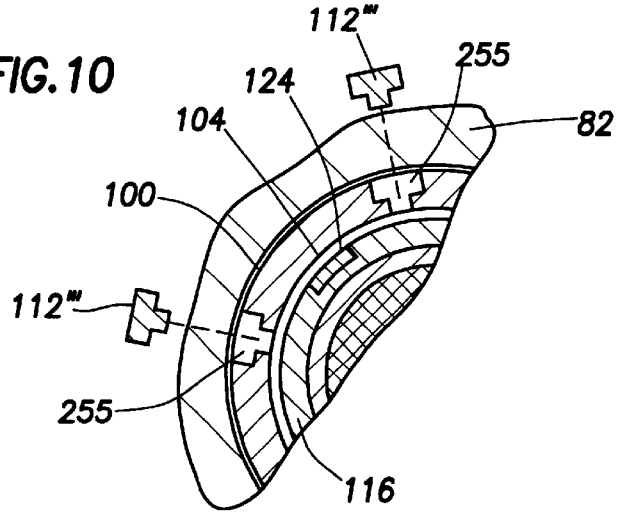
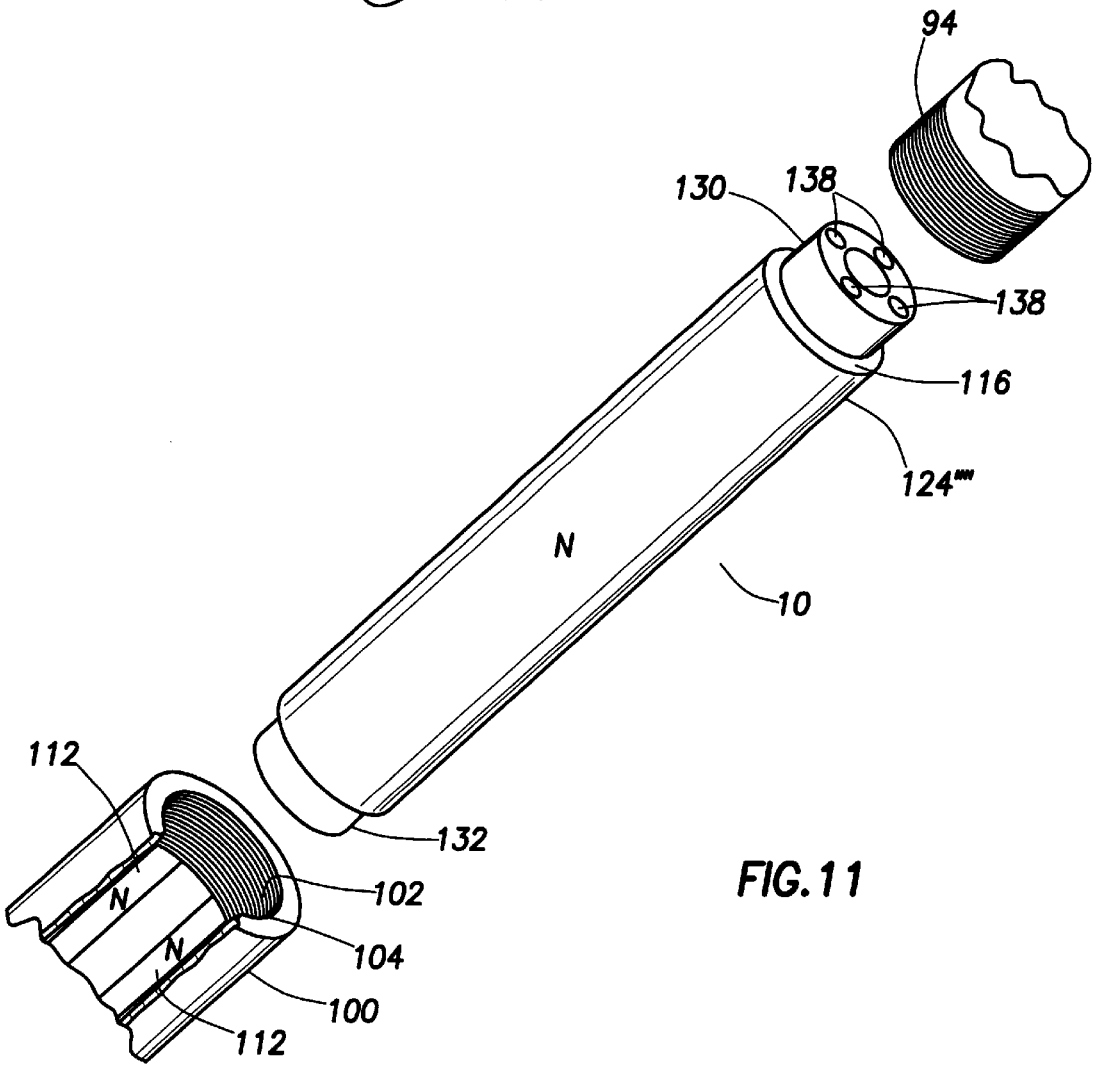
FIG. 11

THERMAL INSULATION VESSEL

BACKGROUND OF THE INVENTION

1. Field of the Invention

This application relates generally to downhole tools, and more particularly to a thermal insulation vessel that may be used in conjunction with downhole tools for thermally isolating various components.

2. Description of the Related Art

Oil and gas wells subject downhole tools to extreme environmental conditions. Ambient pressures can be several orders of magnitude greater than atmospheric pressure. Temperatures can exceed 200° C., and loads and vibrations associated with fluid flow, string weight and impacts with formations and casing can be immense. The design of tools to operate in the downhole environment involves careful consideration of these pressure, temperature and load factors.

Throughout much of the history of the oil and gas well industry, heat transfer considerations played a subordinate role to other design considerations, such as tool static and fatigue strength, seal integrity, and corrosion resistance, to name just a few. With the advent of tools incorporating various electrical components, such as logging tools, measurement while drilling ("MWD") and logging while drilling ("LWD") tools, heat transfer considerations became more important and designers began to turn their attention toward providing thermal insulation for certain types of thermally sensitive electrical and electronic components housed within a tool. There are currently many examples of components used in downhole tools that may benefit from thermal protection. Examples of these include, integrated circuits, sensor packages, battery packs, and electric motors to name just a few.

One type of downhole tool employed in oil and gas wells is an initiating device or initiator. An initiator is commonly used to provide a short burst of high pressure gas or a gaseous mixture that is used to actuate some type of mechanical mechanism in another downhole tool, such as a packer, an intervention tool, or other such tool. Many conventional initiators consist of a tubular housing that encases a firing head which includes a propellant charge for delivering the high pressure gaseous mixture, and an onboard power and control system. The initiator is brought into engagement with the packer or intervention tool either at the surface or downhole, and fired with the aid of a timer set to trigger at a preselected time after downhole insertion or by command sent from the surface. After the initiator fires, it is normally withdrawn from the bore hole. As with many types of modern tools, initiators can incorporate components that may benefit from thermal isolation, such as battery packs and integrated circuits.

Heat transfer between structures within a downhole tool involves a complex combination of conductive, convective and radiative heat transfer. Although, conduction is often the primary heat transfer mechanism, forced convection may be significant where there is through-tool and external fluid flow. Natural convection can come into play where fluids such as air and hydraulic fluids are housed within the tool. Several methods have been employed in the industry to control heat transfer in downhole tools.

Some conventional downhole tools rely upon the forced convective heat transfer associated with mud or other working fluid flow through the tool to carry away heat. Others incorporate heat sinks into the internal structure of the tool.

Still others attempt to shield or otherwise isolate a thermally sensitive component from ambient sources of heat. Some of these conventional thermal isolation designs involve the encasement of the thermally sensitive component within a shell or housing that is provided with a thermally insulating blanket or jacket that shrouds the housing. Another common conventional thermal isolation design involves the encasement of the thermally sensitive component within a tubular flask that is, in turn, encased within another housing and supported therein by a plurality of support pegs that are in physical contact with the outer housing and the inner flask. Various materials have been used to fabricate the support pegs, such as carbon and alloy steels, aluminum, and-synthetic materials, such as plastics, and various ceramic materials.

There are several disadvantages associated with conventional thermal isolation designs. Reliance on forced convection via a working fluid introduces unpredictability, as actual flow rates, densities and temperatures observed downhole may deviate from anticipated norms. Those designs which incorporate an insulation flask supported by pluralities of support pegs reduce somewhat the potential for conductive heat transfer between the component in the flask and external structures. However, the pegs themselves still present multiple conductive heat transfer pathways. This is particularly so where the support pegs are fabricated from materials with relatively high thermal high conductivities, such as metallic materials. The incorporation of support pegs fabricated from non-metallic materials with lower thermal conductivities reduces the potential for damaging heat transfer for a given flask. However, even with non-metallic support pegs, there remains a plurality of physical conductive heat transfer pathways. Where the temperature difference between the interior and the exterior of the flask, i.e., $\Delta T$ is large enough, significant heat transfer may still occur across the support pegs.

The present invention is directed to overcoming or reducing the effects of the one more of the foregoing disadvantages.

SUMMARY OF THE INVENTION

In accordance with one aspect of the present invention, a thermal insulation vessel is provided that includes a first housing that has a first internal cavity and an inner wall. A first magnet is coupled to the first housing. A second housing is positioned in the first internal cavity and has a second internal cavity and an outer wall. A second magnet is coupled to the second housing. The second magnet interacts with the first magnet to maintain a gap between the inner wall and the outer wall.

In accordance with another aspect of the present invention, a downhole tool assembly is provided that includes a downhole tool and a thermal insulation vessel coupled to the downhole tool. The thermal insulation includes a first housing that has a first internal cavity and an inner wall. A first magnet is coupled to the first housing. A second housing is positioned in the first internal cavity and has a second internal cavity and an outer wall. A second magnet is coupled to the second housing and interacts with the first magnet to maintain a gap between the inner wall and the outer wall.

In accordance with another aspect of the present invention, a thermal insulation vessel is provided that includes a first housing that has a first internal cavity and an inner wall. A first plurality of magnets is coupled to the first housing and positioned proximate the inner wall in circumferentially spaced-apart relation. A second housing is positioned in the first internal cavity and has a second internal cavity and an outer wall. A second plurality of magnets is coupled to the second housing and positioned proximate the outer wall in circumferentially spaced-apart relation. The second plurality of magnets interacts with the first plurality of magnets to maintain a gap between the inner wall and the outer wall.

In accordance with another aspect of the present invention, a method of thermally insulating a first component from a second component that is positioned in the first component is provided. The method includes magnetically levitating the second component within the first component to eliminate physical contact between the first and second components.

BRIEF DESCRIPTION OF THE DRAWINGS

The foregoing and other advantages of the invention will become apparent upon reading the following detailed description and upon reference to the drawings in which:

FIGS. 2A–2F are sectional views of the thermal insulation vessel shown in FIG. 1 in accordance with the present invention;

FIG. 4 is a sectional view of FIG. 2C taken at section 4—4 in accordance with the present invention;

FIG. 5 is a partially exploded pictorial view of the thermal insulation vessel in accordance with the present invention;

FIG. 10 is a magnified sectional view like FIG. 6 depicting another alternate exemplary embodiment in accordance with the present invention;

FIG. 11 is a pictorial view like FIG. 5 showing another alternate exemplary embodiment of the thermal insulation vessel in accordance with the present invention;

DETAILED DESCRIPTION OF SPECIFIC EMBODIMENTS

Figure 1:
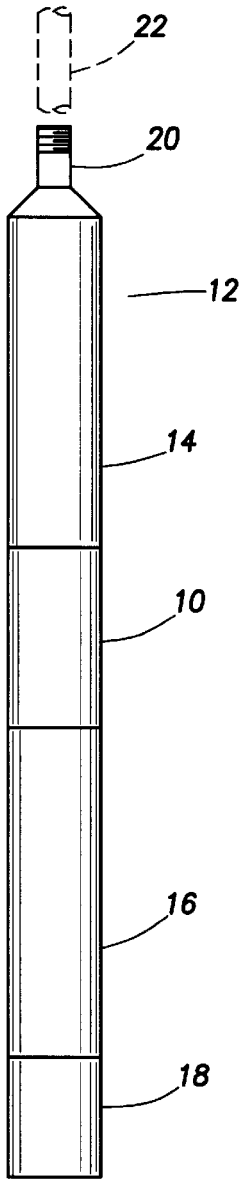
FIG. 1 is a side view of an exemplary embodiment of a thermal insulation vessel in accordance with the present invention.

In the drawings described below, reference numerals are generally repeated where identical elements appear in more than one figure. Turning now to the drawings, and in particular to FIG. 1, there is shown a schematic side view of an exemplary embodiment of a thermal insulation vessel 10 that is coupled to a downhole tool 12. The downhole tool 12 consists of upper and lower segments or subs 14 and 16 connected to the thermal insulation vessel 10 and a firing head 18 connected to the lower segment 16. The downhole tool 12 is provided with an upper connector 20 that is adapted to couple to a tubular member 22, which may be a conducting or non-conducting wireline, another downhole tool, a section of drill pipe, coiling tubing or the like. As described more fully below, the thermal insulation vessel 10 is designed to provide thermal isolation between a component or components stored therein and the environment external to the thermal insulation vessel 10. Although the downhole tool 12 may be virtually any type of downhole tool, in the embodiment illustrated in FIG. I and in various of the figures to be described below, the downhole tool 12 is an initiator designed to provide initiation of a propellant or chemical charge, or a mechanical mechanism to actuate various types of downhole tools, such as, for example, setting tools, intervention tools, packers or the like.

Figure 2A:
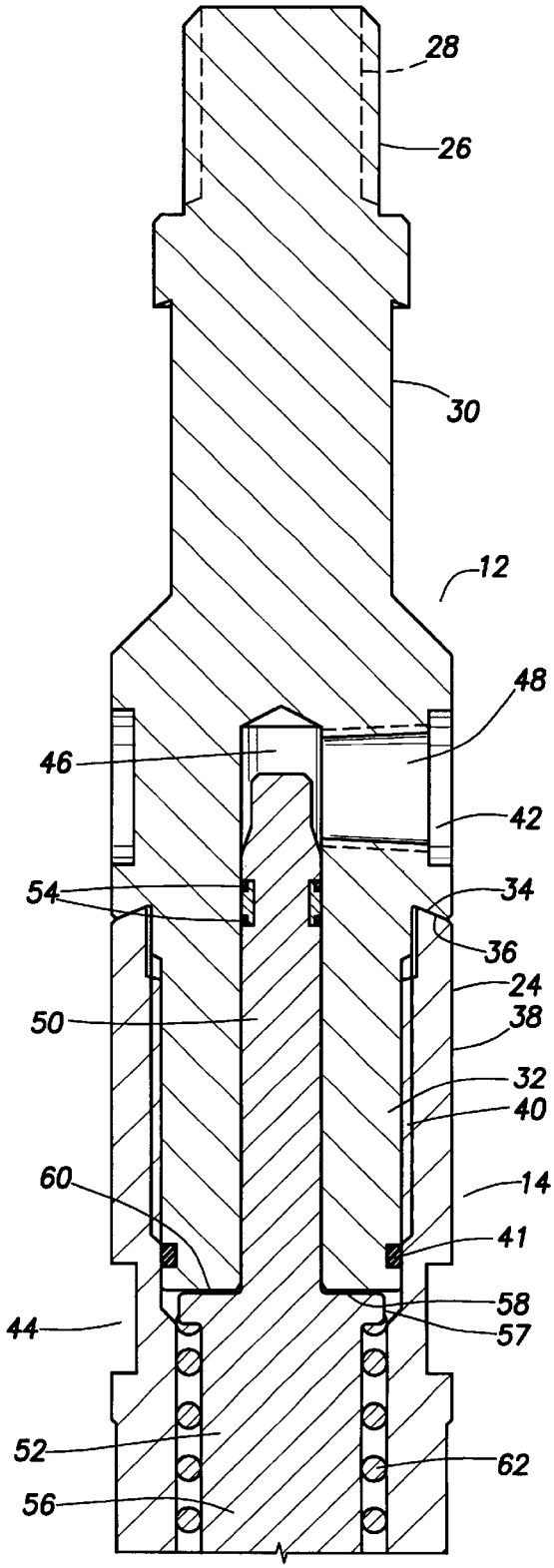

The detailed structures of the thermal insulation vessel 10 and the initiator 12 may be understood by referring now to FIGS. 2A–2F, 3 and 4. The thermal insulation vessel 10 and the initiator 12 are of such length that they are shown in six longitudinally broken cross-sectional views, visa vis, FIGS. 2A–2F. Referring initially to FIG. 2A, the initiator 12 is provided with a tubular housing 24 that consists of a number of tubular sections interconnected together. The upper section 26 of the housing 24 is adapted for connection to the tubular member 22 shown in FIG. 1. This connection may be by threaded connection as indicated by the threads 28, or by a variety of other well known joining methods. A fishing neck 30 is provided beneath the threaded connection 28 to enable the initiator 12 to be readily fished from the downhole environment in the event the tubular member 22 depicted in FIG. 1 fails or has insufficient strength to withdraw the initiator 12 from the downhole environment. The lower end 32 of the upper section 26 is provided with a reduced diameter that defines a downwardly facing annular shoulder 34. This downwardly facing annular shoulder 34 may be substantially horizontal or angled as shown in FIG. 2A. The downwardly facing annular shoulder 34 abuts against an upwardly facing annular shoulder 36 formed on an intermediate section 38 of the housing 24. The outer diameter of the lower end 32 of the upper section 26 is threadedly engaged with the inner diameter of the intermediate section 38 at 40 and sealed by O-ring 41. The outer surfaces of the upper section 26 and the intermediate section 38 are provided with respective wrench slots 42 and 44 to enable the sections 26 and 38 to be readily threaded together at 40.

An internal bore 46 is provided inside the upper section 26. The bore 46 is vented to the exterior of the initiator 12 by a passage 48. The upper end 50 of a piston 52 is slidably positioned within the bore 46, and sealed against fluid passage by O-rings 54. The lower end 56 of the piston 52 is provided with a flange 57 that defines an upwardly facing annular shoulder 58 that abuts against a downwardly facing annular surface 60 of the lower end 32 of the upper section 26. The piston 52 is normally biased against the annular surface 60 by a spring 62 that shoulders against the flange 57 at its upper end and against an upwardly facing annular surface 63 of the intermediate section 38.

The lower end 56 of the piston 52 is fitted with a magnet assembly 64. The detailed structure of the magnet assembly 64 may be understood by referring now to FIG. 2B and to FIG. 3, which is a sectional view of FIG. 2B taken at section 3—3. The magnet assembly 64 includes a magnet holder 66 that is threadedly engaged in a bore 68 formed in the lower end 56 of the piston 52. The magnet carrier 66 includes bores 70 in which respective magnets 72 are positioned. The number, size and spacing of the magnets 72 are largely matters of design discretion. In the illustrated embodiment, the magnet carrier 66 is provided with four circumferentially spaced permanent magnets 72.

The magnet assembly 64 is designed to activate a magnetic switch assembly 74 that consists of a plurality of magnetic switches 76 mounted to a mounting board 78. The magnetic switches 76 are connected in parallel to two or more conductors 80 which transmit electrical power throughout the initiator 12. The combination of the spring-biased piston 52, the magnet assembly 64 and the magnetic switch assembly 74 provides a pressure activated on/off switch for electrical power transmission inside the initiator 12. In operation, the spring 62 biases the piston 52 against the lower annular surface 60 as shown in FIGS. 2A and 2B. This position provides a significant gap between the magnet assembly 64 and the magnetic switch assembly 74 such that the magnetic switches 76 are open and the circuit for the conductor 80 is open as well. With the piston 52 in this position, the initiator 12 is not energized and may be safely handled by operators at the surface. However, when the initiator 12 is placed in a downhole environment, ambient pressure venting through the port 48 will act upon the upper end 50 of the piston 52. When the force of the pressure acting on the upper end 50 of the piston 52 exceeds the spring force of the spring 62, the piston 52 will move axially downward and bring the magnet assembly 64 into proximity with the magnetic switch assembly 74. When the magnet assembly 64 is brought into close proximity with the magnetic switch assembly 74, one or more of the magnetic switches 76 will close, enabling electrical power to pass through the conductors 80 and 81. A plurality of magnetic switches 76 may be provided to ensure that at least one of the switches 76 will close when the magnet assembly 64 is moved downward. Redundancy in the number of magnetic switches 76 is desirable to ensure that at least one of the switches 76 will close regardless of the particular angular orientation of the magnet carrier 66.

Referring again specifically to FIG. 2B, the lower end of the intermediate section 38 is threadedly engaged to an intermediate section 82 at 83. The joint between the intermediate section 38 and the intermediate section 82 is sealed against fluid passage by a pair of O-rings 84. The axial spacing between the intermediate section 38 and the intermediate section 82 may be adjusted by the incorporation of an annular spacer 85 positioned between the upper end of the intermediate section 82 and a downwardly facing annular shoulder 86 of the intermediate section 38.

The magnetic switch assembly 74 is housed within a chamber 88 in a chassis 90 positioned inside the intermediate section 82. The chassis 90 consists of a cup 92 secured to a cylindrical chassis 94 by two or more bolts 96. The chassis 94 has a centrally disposed bore 98 through which the conductors 80 and 81 pass.

The detailed structure of the thermal insulation vessel 10 may be understood by referring now to FIG. 2C, to FIG. 4, which is a sectional view of FIG. 2C taken at section 4—4, and to FIG. 5, which is a partially exploded pictorial view. The thermal insulation vessel 10 includes an external housing 100 that has an internal cavity 102 and an inner wall 104. The external housing 100 is threadedly engaged at its upper end to the lower end of the chassis 94 at 106 and at its lower end to another chassis 108 at 110. The external housing 100 is provided with a plurality of magnets 112 that are dispersed in circumferentially spaced-apart relation. The magnets 112 are positioned in respective longitudinal slots 114. Another housing 116 is positioned inside the internal cavity 102. The housing 116 has an internal cavity 118 for holding a component for which thermal isolation is desired. In the illustrated embodiment, thermal isolation is desired for a plurality of batteries 120 which are designed to provide electrical power to the initiator 12. The batteries 120 are positioned in a tubular insulating sleeve 121, which may be composed of a material that provides magnetic shielding of the batteries 120. The housing 116 includes an external wall 122 and may be provided with one or more longitudinal slots 123 to accommodate conductors, such as the conductor 81. A plurality of magnets 124 are positioned in respective longitudinal slots 126 in the housing 116. The plurality of magnets 124 coupled to the housing 116 interact with the plurality of magnets 112 coupled to the housing 100 to maintain a gap 128 between the inner wall 102 of the housing 100 and the outer wall 122 of the housing 116. This magnetic levitation of the housing 116 within the housing 100 eliminates the several points of contact normally found in conventional vacuum flasks which represent pathways for conductive heat transfer.

Figure 6:
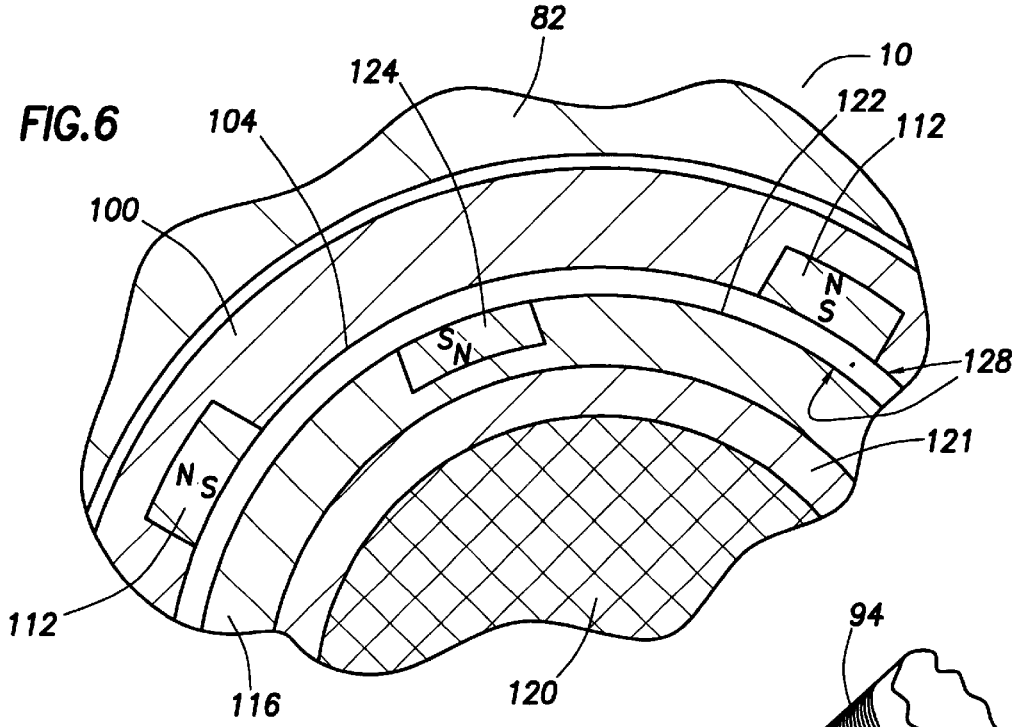
FIG. 6 is a magnified view of a particular portion depicted in FIG. 4 in accordance with the present invention.

The detailed interaction of the plurality of magnets 112 with the plurality of magnets 124 may be understood by referring now also to FIG. 6, which is a magnified view of the portion of FIG. 4 circumscribed generally by the dashed oval 130. The magnets 112 and 124 are positioned such that their like poles, i.e., north or south, face towards each other. In the illustrated embodiment, the magnets 112 and the magnets 124 are positioned such that their respective south poles face each other, and thereby repel to maintain the gap 128 between the inner wall 104 of the housing 100 and the outer wall 122 of the housing 116. The magnets 112 and 124 are positioned in close enough proximity so that the interactions of the north poles of the magnets 112 and the south poles of the magnets 124 provides an attractive force that aids in maintaining the gap 128 and stabilizes the rotational position of the housing 116 relative to the housing 100. When the housing 116 is inserted into the housing 110 during assembly, the housing 116 will rotate relative to the housing 100 until a position of magnetic force equilibrium is reached, as illustrated in FIG. 6. The housing 116 is then effectively locked into position.

Still referring to FIG. 4, radiative heat transfer to the housing 116 may be inhibited by providing the outer wall 122 of the housing 116 with a reflective surface. This may be accomplished by polishing the outer wall 122 where the housing 116 is fabricated from a material that may be polished or electro polished to produce a high sheen. Alternatively, the outer wall 122 may be coated with a highly reflective material, such as chrome, gold, nickel or the like to achieve the desired reflective properties.

Referring again to FIG. 2C, the housing 116 may be provided with upper and lower end caps 130 and 132 which are respectively threadedly engaged with the housing 116 at 134 and 136. The end cap 130 is provided at its upper end with one or more magnets 138 that interact with a corresponding plurality of magnets 140 coupled to the lower end of the chassis 94. The lower end of the end cap 132 is similarly provided with one or more magnets 142 that interact with a corresponding set of magnets 144 coupled to the upper end of the chassis 108. The interactions between the sets of magnets 138 and 140 and 142 and 144 maintain gaps 146 and 148 between the end cap 130 and the chassis 94 and the end cap 132 and the chassis 108. In this way, the housing 116 and its contents may be physically isolated from surrounding structure with the exception of the conductor wires 80 and 81 and a corresponding set of conductor wires 152 and 154 emanating from the lower end of the end cap 132. In this way, the multiple potential heat transfer pathways associated with conventional thermal protection flasks have been eliminated.

Respective annular spacers 156 and 158 are positioned between the end cap 130 and the inner sleeve 121 and the end cap 132 and the lower end of the inner sleeve 121. The spacer 156 is provided with a radial passage 160 that extends radially outwardly to one or more of the conductor passages 123 (see FIG. 4). The spacer 158 similarly is provided with a radial passage 162 which leads to one or more of the conductor passages 123 (see FIG. 4). The thermal insulation vessel 10 is protected from axial shock loads by the incorporation of an elastomeric ring 164 positioned between the lower end of the end cap 130 and the upper surface of the spacer 156. A substantially identical elastomeric annular member 166 is positioned between the lower surface of the spacer 158 and the upper end of the end cap 132.

The housing 100, the housing 116, the end caps 130 and 132, the chassis 94 and 108 and the spacers 156 and 158 are advantageously composed of non-magnetic materials. Exemplary materials for the housing 100, the housing 116, the end caps 130 and 132, the chassis 94 and 108 include, for example, Inconel 718, aluminum, aluminum-bronze, beryllium-copper alloys, titanium alloys or the like. Exemplary materials for the spacers 156 and 158 include, for example, fiberglass epoxy or thermo-plastics or the like.

Figure 2D:
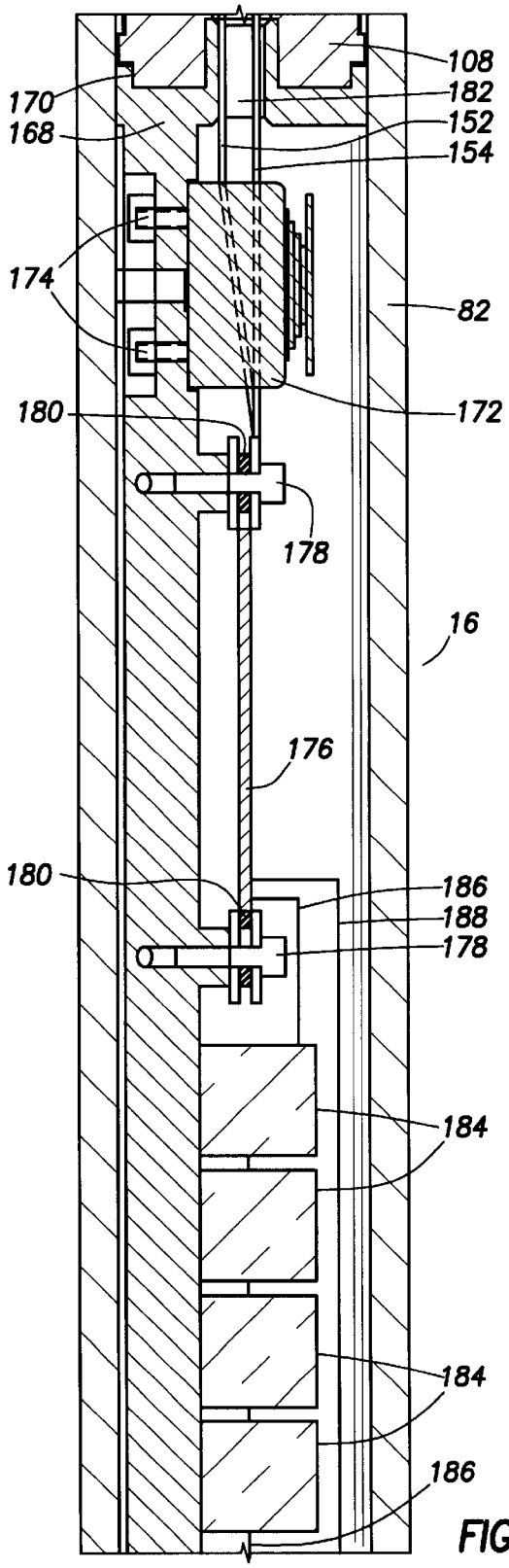

Referring now to FIG. 2D, the lower end of the chassis 108 is threadedly engaged to the upper end of a chassis 168 at 170. An electric buzzer 172 is coupled to the chassis 168 by two or more bolts 174. As described more fully below, the buzzer 172 is designed to provide audible signals regarding the operation of the initiator 12 that can be readily sensed at the surface. Circuitry for controlling the flow of electrical power to the firing head 18 (see FIG. 1) is mounted on a circuit board 176 that is coupled to the chassis 168 by mounting pegs 178. The circuit board 176 is protected from shock loads by a pair of elastomeric annular members 180 respectively mounted on the mounting pegs 178. The conductors 152 and 154 pass through a centrally disposed bore 182 in the upper end of the chassis 168 and tied to the circuit board 176.

Power to activate the firing head 18 (see FIG. 1) is supplied by a plurality of capacitors 184 mounted on the chassis 168, and connected to the circuit board 176 and to the firing head 18 (see FIG. 1) by conductors 186 and 188. The capacitors 184 are continuously charged by the batteries 120. Note that the number of conductors 80, 81, 152, 154 and any others connecting the batteries 120, the firing head 18 (see FIG. 1) and the circuit board 176 is a largely a matter of design discretion.

Figure 2E:
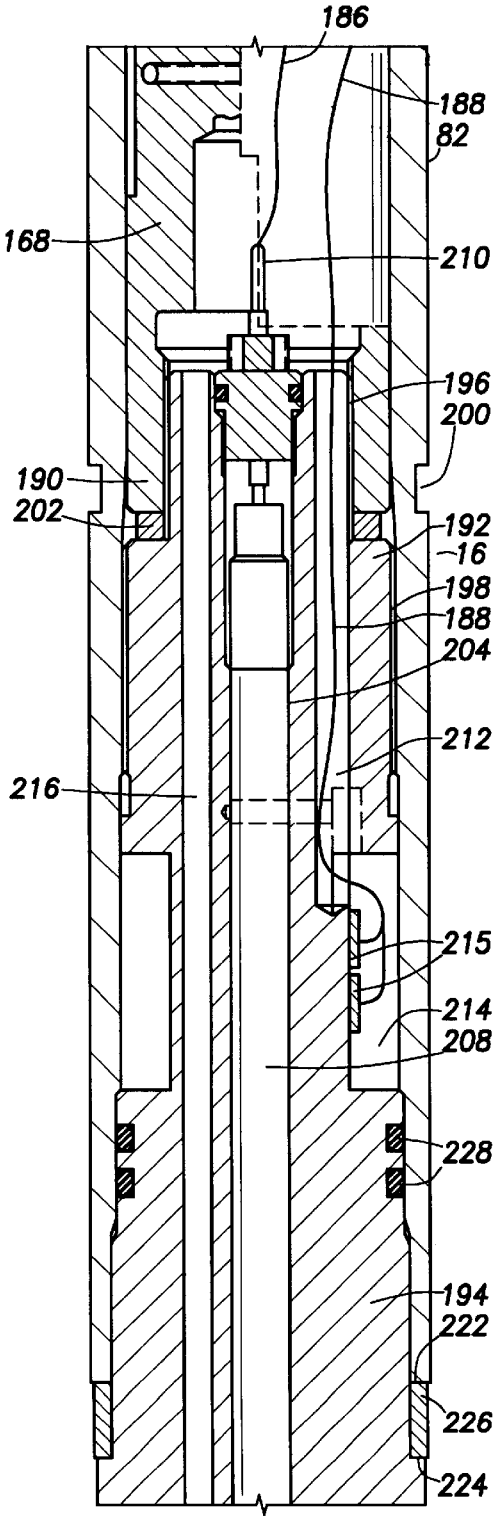
Figure 2F:
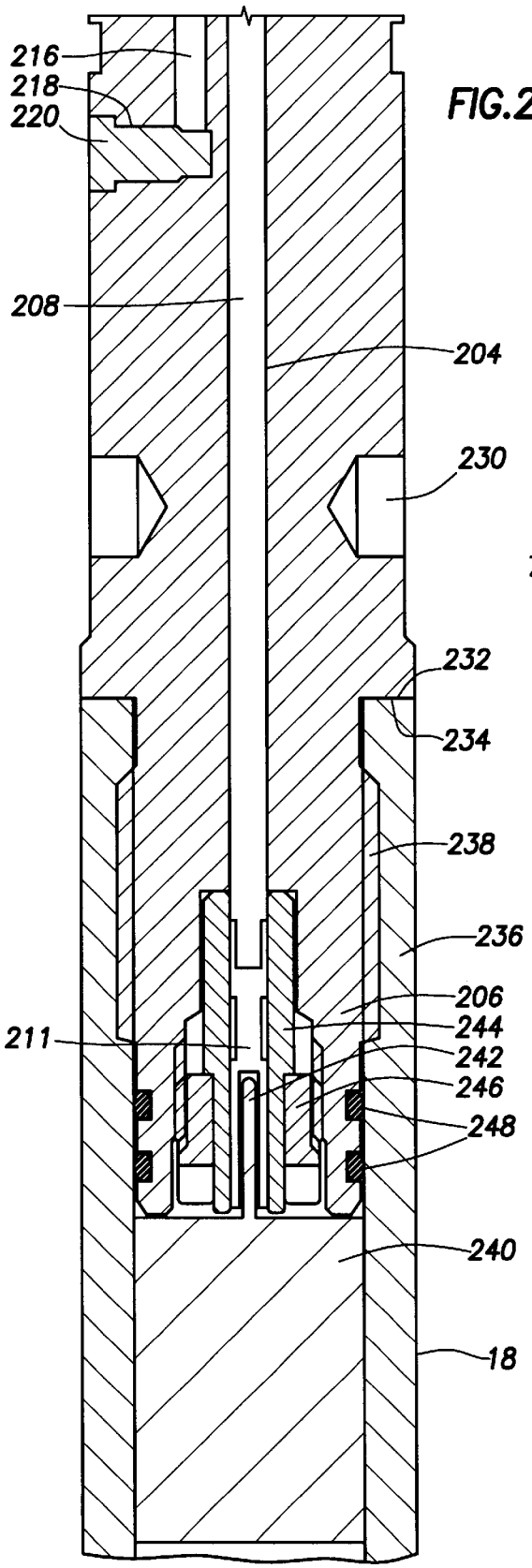
Figure 3:
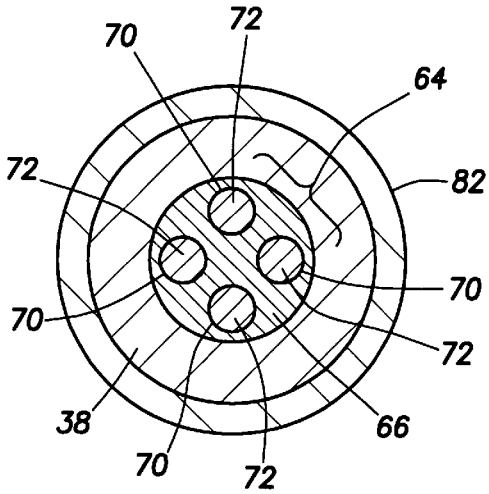
FIG. 3 is a sectional view of FIG. 2B taken at section 3—3 in accordance with the present invention.

The structure of the lower end of the lower segment 16 of the initiator 12 and the firing head 18 may be understood by referring now to FIGS. 2E and 2F. Referring initially to FIG. 2E, the lower end 190 of the chassis 168 is threadedly engaged with the upper end 192 of a chassis 194 at 196. The upper end 192 of the chassis 194 is also threadedly engaged with the intermediate housing section 82 at 198. The intermediate housing section 82 is provided with an external wrench slot 200 to facilitate the relative turning required to threadedly engage the chassis 194 to the section 82 at 198. To ensure that proper spacing is provided between the lower end 190 of the chassis 168 and the upper end 192 of the chassis 194, a jam nut 202 is threadedly engaged to the upper end 192 of the chassis 194 between the lower end 190 of the chassis 168 and the upper end 192 of the chassis 194. The chassis 194 is provided with a centrally disposed bore 204 that extends longitudinally to the lower end 206 of the chassis 194. A conductor 208 is disposed in the bore 204 and is connected at its upper end to a connector 210 and at its lower end to another connector 211. The upper end of the connector 210 is connected to the conductor 186. The other conductor 188 passes downward through a longitudinal conduit 212 formed in the upper end 192 of the chassis 194. The conduit 212 terminates at its lower end in an annular chamber 214. One or more strain gauges 215 are mounted to the chassis 194 within the annular chamber 214. The strain gauges 215 are designed to sense the selective application of axial loads applied to the initiator 12 from the surface that are used to selectively activate the initiator 12 as described more fully below. The chassis 194 is also provided with a longitudinal conduit 216 that extends from the upper end 192 and terminates in an external vent 218. The conduit 216 enables the lower section 16 of the initiator 12 to be evacuated if desired. The vent 218 is closed off by a threaded plug 220.

Desired spacing between the lower annular surface 222 of the intermediate section 82 and an upwardly facing annular shoulder 224 of the chassis 194 is maintained by an annular spacer 226 positioned therebetween. Fluid leakage between the intermediate section 82 and the chassis 194 near the lower annular surface 222 is prevented by a pair of O-rings 228. The exterior of the lower end 206 of the chassis 194 is provided with a wrench slot 230 to facilitate the threaded makeup of the chassis 194 with the intermediate section 82.

The lower end 206 of the chassis 194 is provided with a reduced diameter section that defines a downwardly facing annular surface 232 against which an upwardly facing annular surface 234 of the firing head housing 236 may abut. The firing head housing 236 is threadedly engaged to the lower end 206 of the chassis 194 at 238. The housing 236 encloses an igniter 240 which is electrically coupled to the connector 211 by a male connector 242. The connector 211 is positioned within the lower end 206 by a tubular sleeve 244 that is held in position by a spin collar 246. The joint between the housing 236 and the lower end 206 is sealed against fluid intrusion by a pair of O-rings 248. The igniter 240 may be any of a variety of commercially available igniter. In an exemplary embodiment, the igniter is a Titan model 6000-000-150 supplied by Titan Specialties, Inc.

The operation of the initiator 12 may be understood by referring now to FIGS. 1 and 2A–2F. After the initiator 12 is inserted into a downhole environment, ambient pressure propels the piston 52 shown in FIGS. 2A and 2B downward, activating the magnetic switch assembly 74. With the magnetic switch assembly 74 turned on, the initiator 12 is operable and ready to receive commands from the surface in the form of axial load pulses delivered through the support member 22. When the initiator 12 is positioned at the desired location downhole, a preselected series of axial load pulses are transmitted through the support member 22 and into the initiator 12. These pulses are sensed by the strain gauges 215 depicted in FIG. 2E. The outputs of the strain gauges 215 are fed to the sensing circuitry on the circuit board 176 shown in FIG. 2D. In response, the circuit board 176 initiates the firing sequence, which may consist of an instantaneous discharge of the electrical power stored in the capacitors 184 into the igniter 240 depicted in FIG. 2F or a time-delayed discharge of the capacitors 184. The circuit board 176 also activates the buzzer 172 to transmit an acoustic signal uphole indicating the initiation of the firing sequence. When the igniter 240 is activated, a propellant charge stored therein is consumed, releasing a hot burst of gas which may be used to activate any of the aforementioned tools that may be used with the initiator 12. While in the downhole environment, the component housed within the thermal insulation vessel 10, in this case the plurality of batteries 120, is thermally insulated from the elevated temperatures associated with the downhole environment by the thermal insulation vessel 10.

Figure 7:
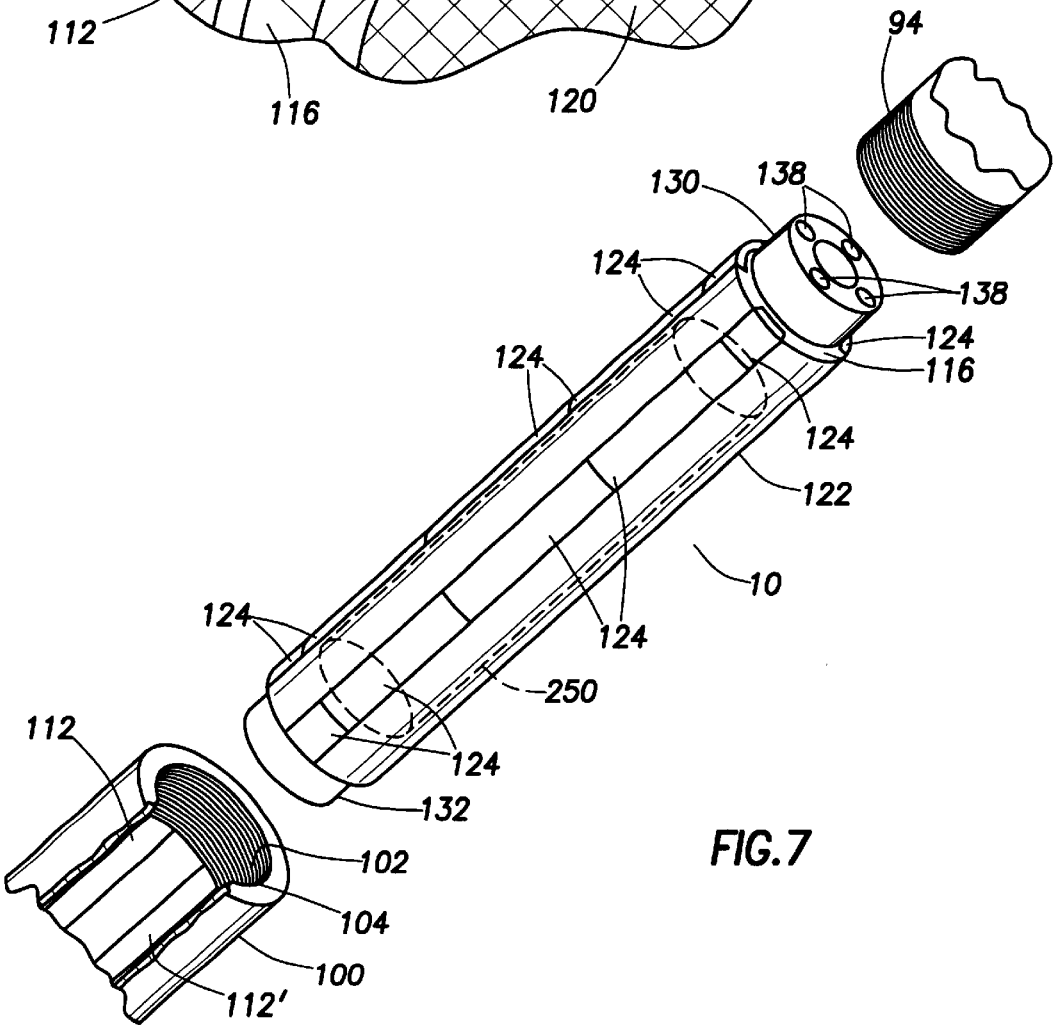
FIG. 7 is a pictorial view like FIG. 5 showing other types of components enclosed within the thermal insulation vessel in accordance the present invention.

In the foregoing illustrated embodiment, the component enclosed within the thermal insulation vessel 10 consists of the plurality of batteries 120 shown in FIG. 2C. However, the skilled artisan will appreciate that the thermal insulation vessel 10 may be used to enclose and thermally isolate a large variety of different types of components. The concept is illustrated in FIG. 7, which is a partially exploded pictorial view like FIG. 5. A component 250, schematically represented in phantom, is enclosed within the housing 116 of the thermal insulation vessel 10. The component 250 may be any of a variety of components used in downhole tools that may benefit from thermal isolation. For example, the component 250 may be a heat generating apparatus, such as, for example, a hydraulic pump and motor assembly. In this circumstance, it may be desirable to restrict heat transfer from the component 250 to external structures that may be thermally sensitive, such as electronic circuitry. Conversely, where the component 250 may be sensitive to elevated temperatures associated with the downhole environment, the thermal insulation vessel 10 will limit the amount of heat that may be transferred to the component 250. In this regard, the component 250 may be a hydraulic motor, one or more capacitors, a transformer, one or more batteries, an integrated circuit, or various combinations of these, to name just a few.

Figure 8:
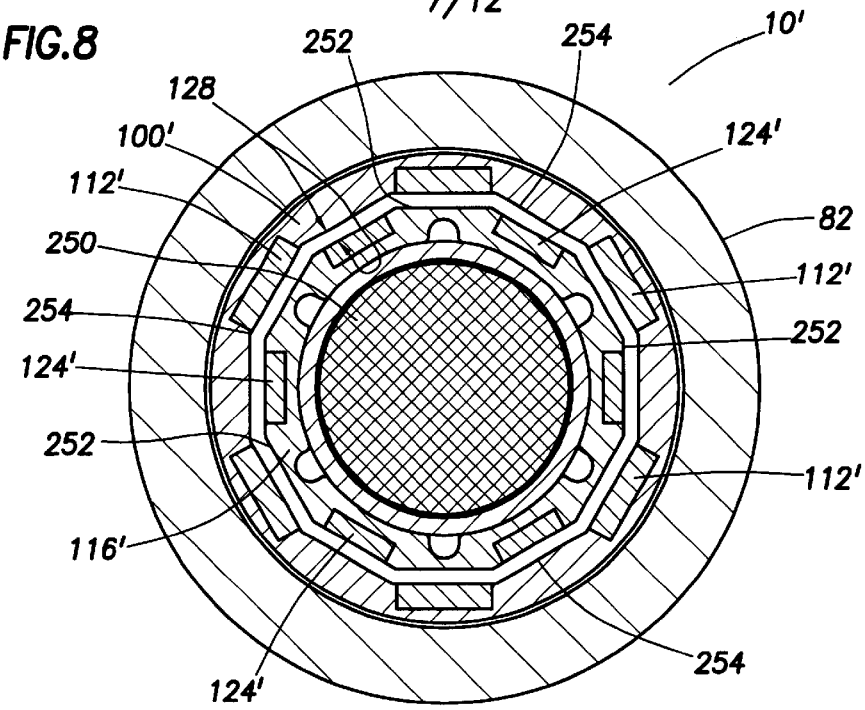
FIG. 8 is a sectional view like FIG. 4 depicting an alternate exemplary embodiment of the thermal insulation vessel in accordance with the present invention.

In the above described exemplary embodiment, the inner and outer housings 116 and 100 of the thermal insulation vessel 10 have a generally circular cross-section. The interacting pluralities of magnets 112 and 124 are provided with a generally arcuate cross-section that matches the profiles of the respective housings 100 and 116. Furthermore, the respective pluralities of magnets 112 and 124 are positioned such that their respective-like magnetic poles face each other and thereby repel. However, as the skilled artisan will appreciate, a variety of alternative arrangements fall within the spirit and scope of the present invention. FIG. 8 is a sectional view like FIG. 4 of an alternate exemplary embodiment of the thermal insulation vessel, now designated 10', in accordance with the present invention. In this embodiment, the internal housing, now designated 116', may be provided with a plurality of external flats or facets 252 and the outer housing, now designated 100', may be provided with a complimentary plurality of internally facing facets 254. The incorporation of the pluralities of facets 250 and 252 into the housings 100' and 116' facilitate the incorporation of rectangularly cross-sectioned magnets, now designated 112' and 124'. The enclosed component 250 is otherwise protected from heat transfer in the same general manner by the gap 128.

Figure 9:
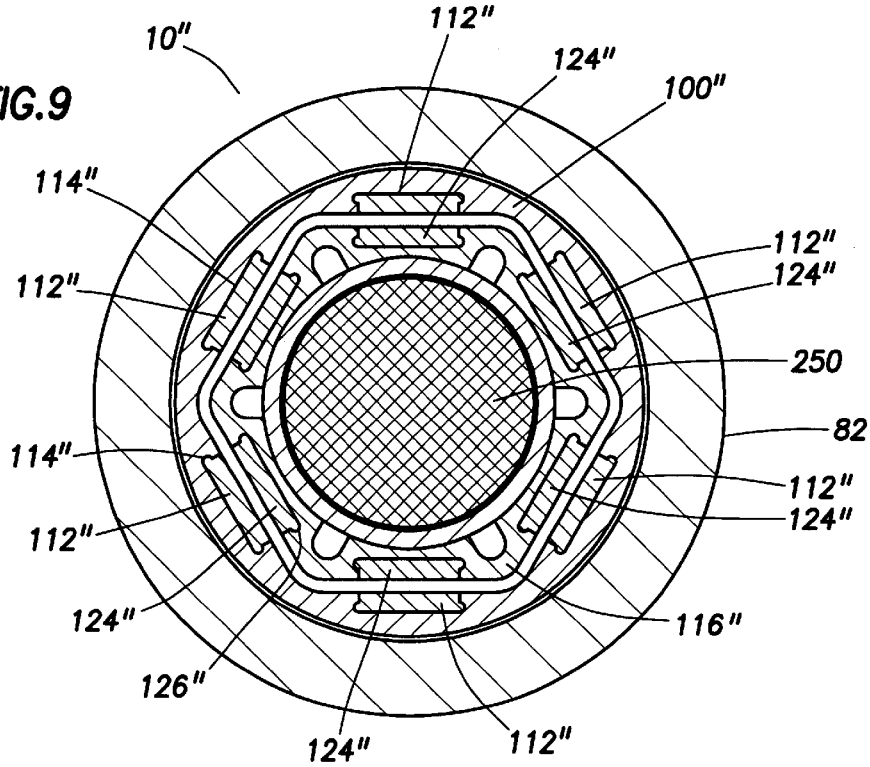
FIG. 9 is a sectional view like FIG. 4 depicting an alternate exemplary embodiment of the thermal insulation vessel in accordance with the present invention.

Another alternate exemplary embodiment in accordance with the present invention may be understood by referring now to FIG. 9, which is a sectional view like FIG. 4. Whereas, in the foregoing illustrated embodiments, respective pluralities of magnets are positioned such that their like poles face each other, the embodiment depicted in FIG. 9, illustrates that respective pluralities of magnets, now designated 112" and 124" may be positioned such that their respective opposite magnetic poles are facing each other. The attractive force between any two adjacently disposed magnets 112" and 124" is counteracted by the attractive force between a diametrically opposed pair of magnets 112" and 124". To aid in retaining the plurality of magnets 112" coupled on the outer housing, now designated 100", the slots 114" in which the magnets 112" are positioned and provided with a bullnosed cross-section. The magnets 112" are formed with a cross-section that has a widened base that engages the bullnosed cross-sections of the slots 114". The plurality of magnets 124" may be provided with similarly widened-base cross-sections to facilitate their retention in bullnosed cross-section slots 126" fashioned in the internal housing 116".

The various magnets may be retained on the housings 100 and 116 by interference, adhesives or other well known fastening techniques. In an alternate exemplary embodiment shown in FIG. 10, which is a partial sectional view like FIG. 6, the magnets 112''' are dropped into shouldered slots 255 formed in the housing 100. The slots 255 may extend to the inner wall 104 of the housing 100. The magnets 112''' are shaped to seat in the slots 255 so that a portion of each magnet 112''' is exposed to the housing 116. A similar arrangement may be used to mount magnets on the housing 116 as well.

In another alternate exemplary embodiment in accordance with the present invention, the plurality of circumferentially spaced magnets 124 coupled to the housing 116 (see FIG. 5) may be replaced with a single annular magnet 124. Referring now to FIG. 11, which is a pictorial view like FIG. 5, the housing 116 is fabricated as an annular permanent magnet 124"" with a given magnetic pole, in this example magnetic north, facing radially outwardly. The housing 100 may be provided with the aforementioned plurality of circumferentially spaced-apart magnets 112. The arrangement shown in FIG. 11 may be flip flopped, that is, the sleeve 100 may be configured as a single magnet 112 while the sleeve 116 may be fitted with the aforementioned plurality of circumferentially spaced magnets.

Figure 12:
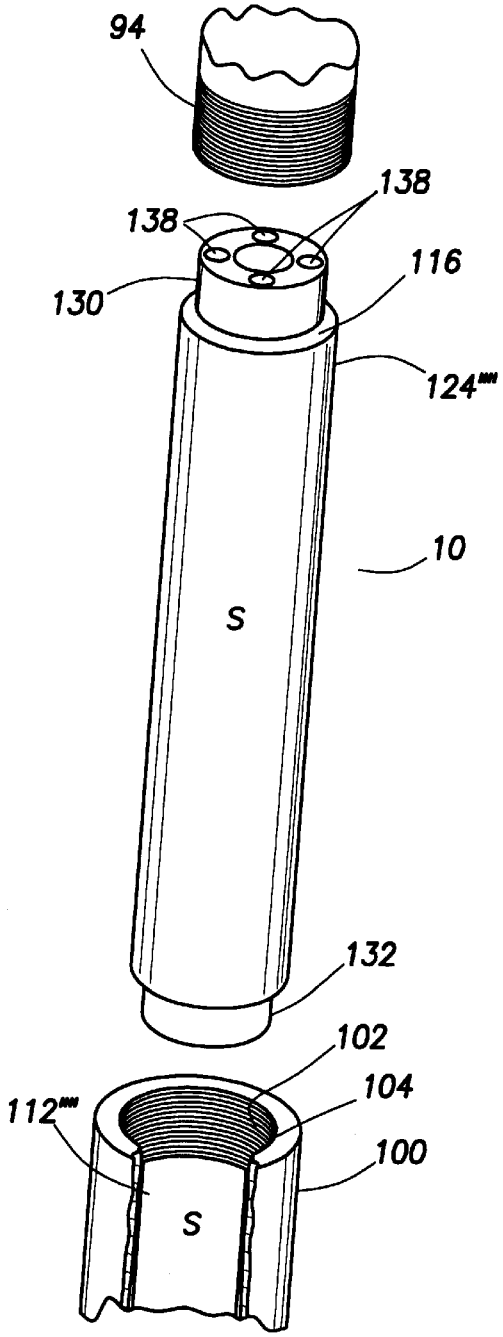
FIG. 12 is a pictorial view like FIG. 5 showing another alternate exemplary embodiment of the thermal insulation vessel in accordance with the present invention.

In another alternate exemplary embodiment in accordance with the present invention shown in FIG. 12, both the sleeve 116 and the sleeve 100 may be configured as single magnets wherein the sleeve 116 has a given magnetic pole, in this example, south, facing radially outwardly and the sleeve 100 has the same magnetic pole facing radially inwardly.

Figure 13:
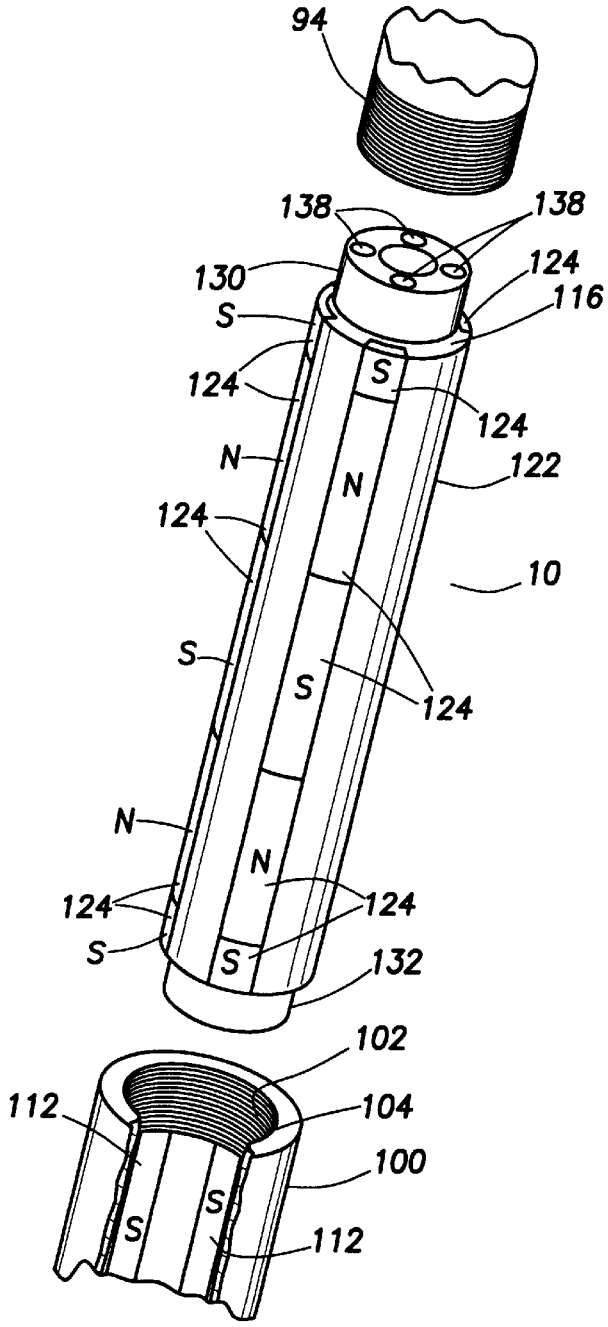
FIG. 13 is a pictorial view like FIG. 5 showing another alternate exemplary embodiment of the thermal insulation vessel in accordance with the present invention.

In the foregoing illustrated embodiments, the respective magnets or sets of magnets have the same type of magnetic pole, that is north or south, facing in a given direction along the entire length of the thermal insulation vessel 10. However, the pluralities of magnets may be arranged such that some of the magnets have a north or south pole facing in a given direction along a given length of the thermal insulation vessel 10 while others project the opposite magnetic pole in that same direction at a different point along other sections of the thermal insulation vessel 10. This concept is illustrated in FIG. 13, which is a partially exploded pictorial view like FIG. 5. As shown in FIG. 10, some of the magnets 124 positioned on the inner housing 116 may have south magnetic poles facing outward while others may have north magnetic poles facing outward. Similarly, the set of magnets 112 coupled to the external housing 100 and facing inwardly, may have south poles facing inwardly along a certain length of the housing 100 and a north poles facing inwardly along the remainder of the outer housing 100. This alternating arrangement of magnetic poles for the magnets 112 and 124 may facilitate the insertion of the inner housing 16 into the outer housing 100. In this way, the inner housing 116 may be inserted into the outer housing 100 with a smaller magnitude of repulsive magnetic force that must be overcome while still maintaining a magnetically levitated inner housing 116 and the thermally isolating gap between the inner housing 116 and the outer housing 100.

Figure 14:
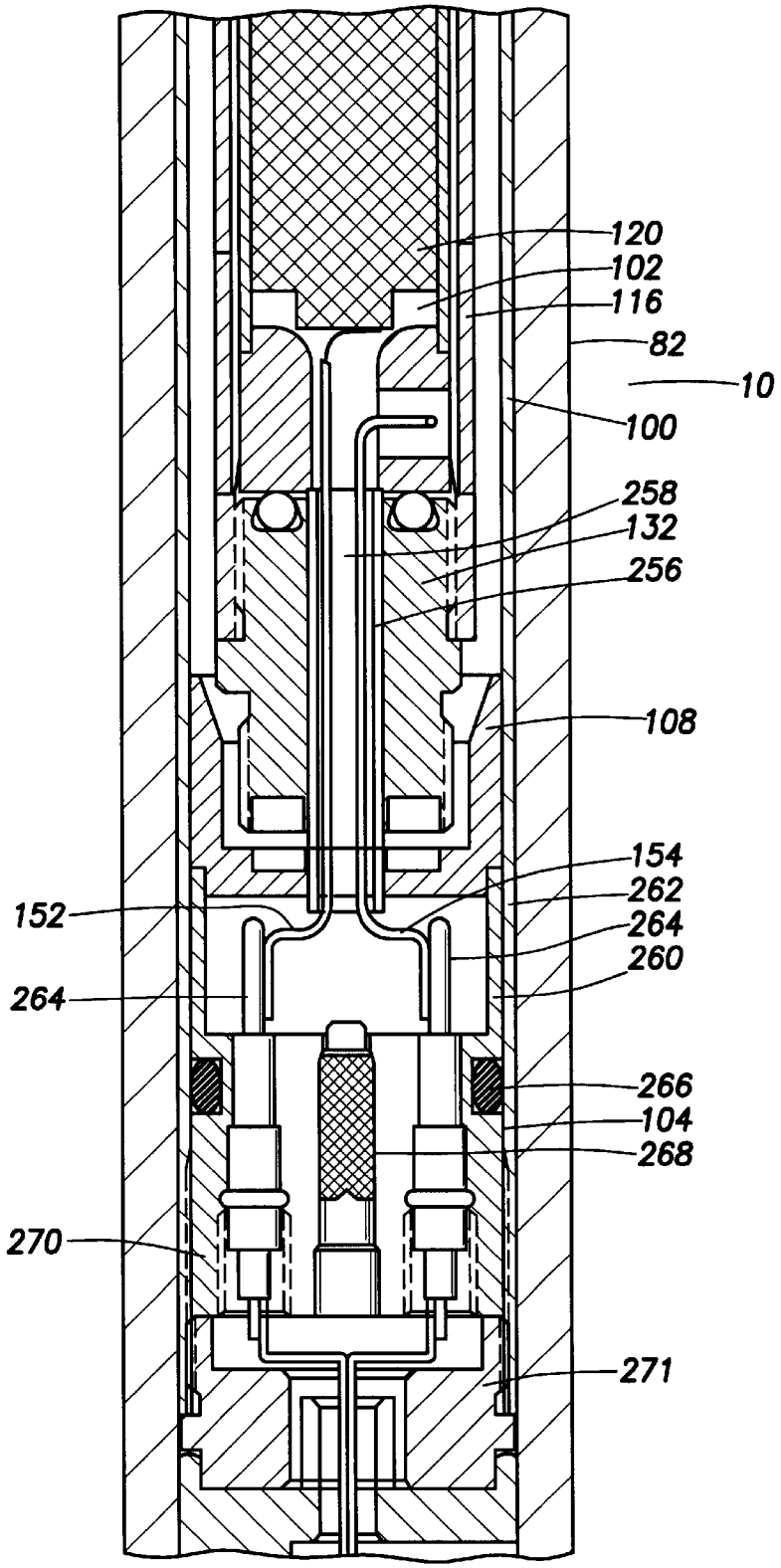
FIG. 14 is a sectional view like FIG. 2C depicting another exemplary embodiment of the thermal insulation vessel in accordance with the present invention.

FIG. 14 illustrates a sectional view like FIG. 2C of an alternate exemplary embodiment in accordance with the present invention in which the inner housing 116 and the outer housing 100 may be evacuated to substantially reduce the potential for gaseous convective or conductive heat transfer. At the time the thermal insulation vessel 10 is fabricated, the internal cavity 102 of the housing 116 may be evacuated and the bore 256 of the end cap 132 may be sealed by inserting a plug therein or by potting with epoxy 258 or the like as shown. In addition, the housing 100 may be evacuated. In this regard, a sleeve 260 may be threadedly engaged to the chassis 108 at 262. The sleeve 260 is provided with one or more electrical connectors 264, which are depicted as pin-socket type connectors, but which may be a myriad of different types of electrical connectors. The conductor wires 152 and 154 emanating from the inner housing 116 may be coupled to the connectors 264. The exterior of the sleeve 260 is provided with an O-ring seal 266 to seal against fluid passage between the inner wall 104 of the housing 100 and the exterior of the sleeve 260. The sleeve 260 is provided with a vacuum fitting 268, which may be a check valve or other type of fitting enabling a vacuum to be drawn. The sleeve 260 is threadedly engaged to the housing 100 at 270. The lower end of the housing 100 is threadedly engaged to an annular member 271 which has the same general structural configuration as the lower end of the chassis 108 depicted in FIG. 2D. Thus, the internal cavity 102 of the housing 116, the housing 100 may be evacuated. In addition, the interior of the intermediate section 82 proximate the chassis 168 may be evacuated as described above using the port 218 as shown in FIGS. 2D and 2F.

Figure 15:
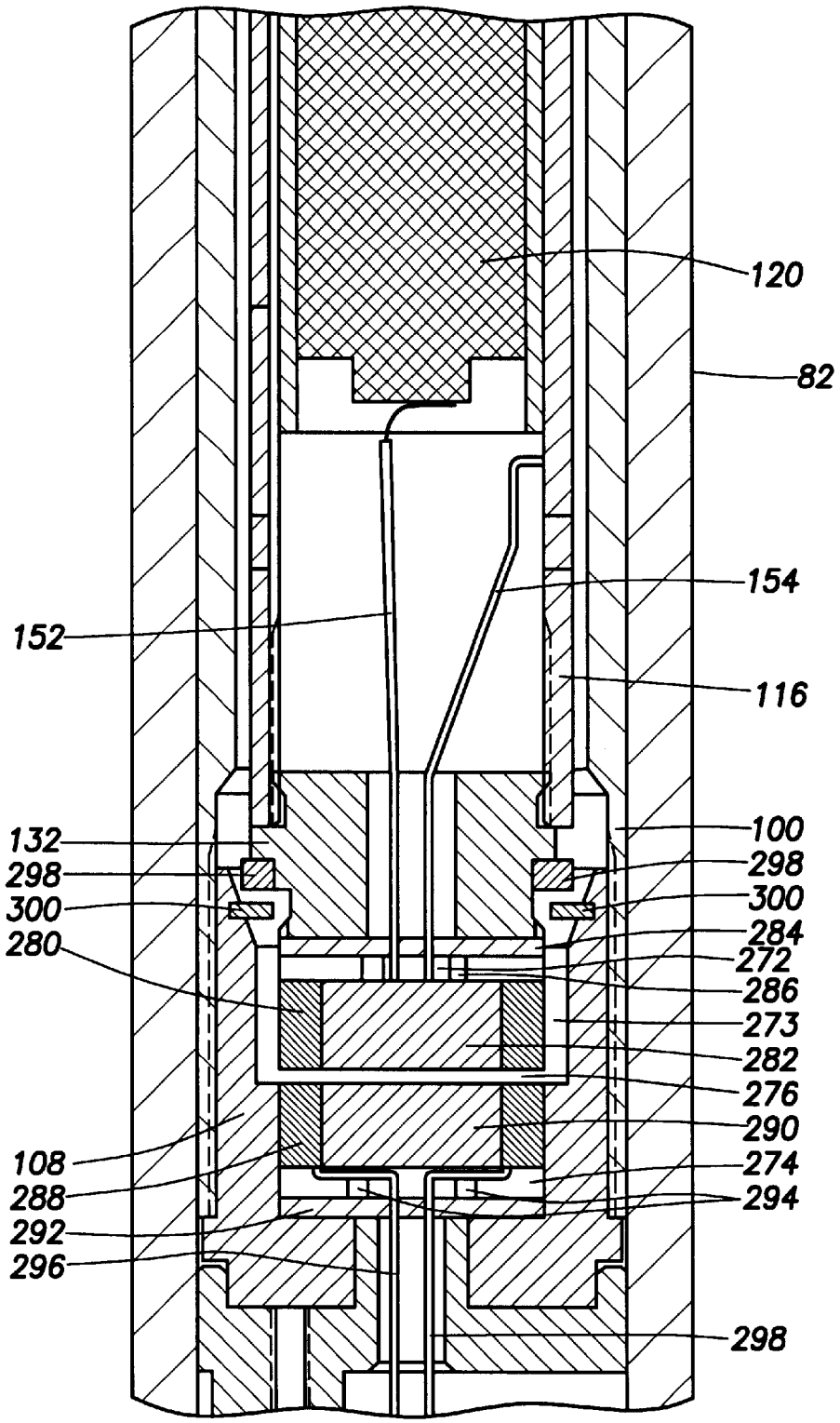
FIG. 15 is a sectional view like FIG. 2C depicting another exemplary embodiment of the thermal insulation vessel in accordance with the present invention.

Complete physical isolation between the inner housing 116, the batteries 120 enclosed therein, and structures external thereto may be provided by inductively coupling the inner housing 116 to conductors external to the housing 116. This alternate exemplary embodiment may be understood by referring now to FIG. 15, which is a sectional view like FIG. 14. An inductive coupling 272 is positioned in the housing 100 and includes inductors 273 and 274 axially separated by a narrow gap 276. The inductor 273 includes an inductor coil 280 wrapped around a core 282. The core 282 is mounted to a mounting board 284 by pegs 286. Adhesives or other fastening techniques may alternatively be used. The mounting board 284 is coupled to the end cap 132 of the housing 116 and includes DC to AC conversion circuitry. The inductor 274 similarly includes an inductor coil 288 wrapped around a core 290 that is mounted to a mounting board 292 by pegs 294. The mounting board 292 is coupled to chassis 108 and includes AC to DC conversion circuitry. The conductors 152 and 154 are connected to the inductor 273. Current is, in turn, transmitted to and from the inductor 274 by two or more conductors 296 and 298. Cooperating sets of magnets 298 and 300 positioned, respectively, on the end cap 132 and the chassis 108 aid in maintaining the axial positioning of the housing 116. A substantially identical inductive coupling 272 may be coupled positioned at the opposite end of the housing 116.

Figure 16:
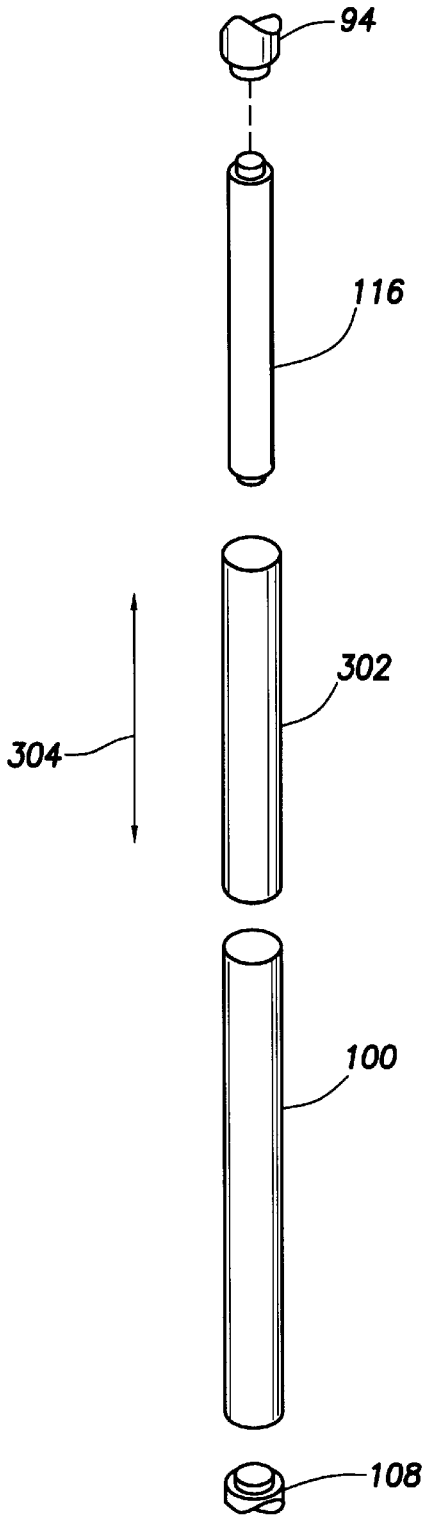
FIG. 16 is an exploded pictorial view of an alternate exemplary embodiment of the thermal insulation vessel in accordance with the present invention.

Another alternate exemplary embodiment of the thermal insulation vessel 10 may be understood by referring now to FIG. 16, which is an exploded pictorial view of the housing 116, the housing 100 and the chassis 94 and 108. In this illustrative embodiment, a thermally conductive heat transfer member or shell 302 is positioned inside the housing 100 and the housing 116 is, in turn, positioned inside the member 302. The member 302 is advantageously composed of a material that is both non-magnetic and exhibits a directionally dependent thermal conductivity. Thus, a gap of the type described above is maintained between the housing 116 and the member 302 by the aforementioned magnetic interactions. The member 302 is designed to have a much higher thermal conductivity along its longitudinal axis 304 than along a radial axis between its inner and outer walls. In this way, heat transferred to the member 302 from either the housing 100 or the housing 116 is quickly conducted away by the member 302 along the longitudinal axis 304. A variety of materials may be used for the member 302. In an exemplary embodiment, thermal pyrolytic graphite with a metallic shell or ceramic matrix may be used, such as, for example, TC 1050.ALY or TC 1050.MMC supplied by Advanced Ceramics Corporation.

The magnets depicted in any of the embodiments described herein may be composed of a wide variety of materials. Exemplary materials include samarium-cobalt, niodidium-iron-boron, or the like. Optionally, although not shown in the drawings, electromagnets may be used in lieu of or in conjunction with permanent magnets.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims.

What is claimed is:

1. A thermal insulation vessel, comprising:

a first housing having a first internal cavity and an inner wall;

a first magnet coupled to the first housing;

a second housing positioned in the first internal cavity and having a second internal cavity and an outer wall;

a second magnet coupled to the second housing, the second magnet interacting with the first magnet to maintain a gap between the inner wall and the outer wall; and a battery positioned in the second internal cavity.

2. A thermal insulation vessel, comprising:

a first housing having a first internal cavity and an inner wall;

a first magnet coupled to the first housing;

a second housing positioned in the first internal cavity and having a second internal cavity and an outer wall;

a second magnet coupled to the second housing, the second magnet interacting with the first magnet to maintain a gap between the inner wall and the outer wall, the inner wall comprising a first plurality of facets.

3. A thermal insulation vessel, comprising:

a first housing having a first internal cavity and an inner wall;

a first magnet coupled to the first housing;

a second housing positioned in the first internal cavity and having a second internal cavity and an outer wall;

a second magnet coupled to the second housing, the second magnet interacting with the first magnet to maintain a gap between the inner wall and the outer wall, the outer wall comprising a second plurality of facets.

4. A thermal insulation vessel, comprising:

a first housing having a first internal cavity and an inner wall;

a first magnet coupled to the first housing;

a second housing positioned in the first internal cavity and having a second internal cavity and an outer wall;

a second magnet coupled to the second housing, the second magnet interacting with the first magnet to maintain a gap between the inner wall and the outer wall, the inner wall comprising a first plurality of facets and the outer wall comprising a second plurality of facets.

5. A thermal insulation vessel, comprising:

a first housing having a first internal cavity and an inner wall;

a first magnet coupled to the first housing;

a second housing positioned in the first internal cavity and having a second internal cavity and an outer wall;

a second magnet coupled to the second housing, the second magnet interacting with the first magnet to maintain a gap between the inner wall and the outer wall; and a conductive heat transfer member positioned between the inner wall and outer wall and having a higher thermal conductivity along a longitudinal axis than an axis passing from the inner wall to the outer wall.

6. A downhole tool assembly, comprising:

a downhole tool; and a thermal insulation vessel coupled to the downhole tool and having a first housing having a first internal cavity and an inner wall, a first magnetic structure coupled to the first housing, a second housing positioned in the first internal cavity and having a second internal cavity and an outer wall, and a second magnetic structure coupled to the second housing, the second magnetic structure interacting with the first magnetic structure to maintain a gap between the inner wall and the outer wall.

7. The downhole tool assembly of claim 6, wherein the first magnetic structure comprises a first plurality of magnets coupled to the first housing and positioned proximate the inner wall in circumferentially spaced-apart relation, the first plurality of magnets interacting with the second magnetic structure to maintain the gap between the inner wall and the outer wall.

8. The downhole tool assembly of claim 7, wherein the second magnetic structure comprises a second plurality of magnets coupled to the second housing and positioned proximate the outer wall in circumferentially spaced-apart relation, the second plurality of magnets interacting with the first plurality of magnets to maintain the gap between the inner wall and the outer wall.

9. The downhole tool assembly of claim 8, wherein the first plurality of magnets and the second plurality of magnets have like magnetic poles facing each other.

10. The downhole tool assembly of claim 8, wherein the first plurality of magnets and the second plurality of magnets have opposite magnetic poles facing each other.

11. The downhole tool assembly of claim 8, wherein a first portion of the first plurality of magnets and a second portion of the second plurality of magnets have like magnetic poles facing each other, and a third portion of the first plurality of magnets and a fourth portion of the second plurality of magnets have opposite magnetic poles facing each other.

12. The downhole tool assembly of claim 6, wherein the first housing has a first end with a third magnet and a second end with a fourth magnet, and the second housing has a third end with a fifth magnet and a fourth end with a sixth magnet, the third and fifth magnets and the fourth and sixth magnets interacting to maintain a gap between the first end of the first housing and the third end of the second housing.

13. The downhole tool assembly of claim 6, comprising a battery positioned in the second internal cavity.

14. The downhole tool assembly of claim 6, wherein the inner wall comprises a first plurality of facets.

15. The downhole tool assembly of claim 6, wherein the outer wall comprises a second plurality of facets.

16. The downhole tool assembly of claim 6, wherein the inner wall comprises a first plurality of facets and the outer wall comprises a second plurality of facets.

17. The downhole tool assembly of claim 6, wherein the first housing is substantially evacuated.

18. The downhole tool assembly of claim 6, wherein the second housing is substantially evacuated.

19. The downhole tool assembly of claim 18, wherein the first housing is substantially evacuated.

20. The downhole tool assembly of claim 6, comprising a first inductive coupling coupled to the second housing.

21. The downhole tool assembly of claim 20, comprising a second inductive coupling coupled to the second housing.

22. The downhole tool assembly of claim 6, wherein the first magnet and the second magnet have like magnetic poles facing each other.

23. The downhole tool assembly of claim 6, wherein the first magnetic structure and the second magnetic structure have opposite magnetic poles facing each other.

24. The downhole tool assembly of claim 6, comprising a conductive heat transfer member positioned between the inner wall and outer wall and having a higher thermal conductivity along a longitudinal axis than an axis passing from the inner wall to the outer wall.

25. A thermal insulation vessel, comprising:

a first housing having a first internal cavity and an inner wall;

a first plurality of magnets coupled to the first housing and positioned proximate the inner wall in circumferentially spaced-apart relation;

a second housing positioned in the first internal cavity and having a second internal cavity and an outer wall;

a second plurality of magnets coupled to the second housing and positioned proximate the outer wall in circumferentially spaced-apart relation, the second magnet interacting with the first magnet to maintain a gap between the inner wall and the outer wall; and a battery positioned in the second internal cavity.

26. A thermal insulation vessel, comprising:

a first housing having a first internal cavity and an inner wall;

a first plurality of magnets coupled to the first housing and positioned proximate the inner wall in circumferentially spaced-apart relation;

a second housing positioned in the first internal cavity and having a second internal cavity and an outer wall;

a second plurality of magnets coupled to the second housing and positioned proximate the outer wall in circumferentially spaced-apart relation, the second magnet interacting with the first magnet to maintain a gap between the inner wall and the outer wall, the inner wall comprising a first plurality of facets.

27. A thermal insulation vessel, comprising:

a first housing having a first internal cavity and an inner wall;

a first plurality of magnets coupled to the first housing and positioned proximate the inner wall in circumferentially spaced-apart relation;

a second housing positioned in the first internal cavity and having a second internal cavity and an outer wall;

a second plurality of magnets coupled to the second housing and positioned proximate the outer wall in circumferentially spaced-apart relation, the second magnet interacting with the first magnet to maintain a gap between the inner wall and the outer wall, the outer wall comprising a second plurality of facets.

28. A thermal insulation vessel, comprising:

a first housing having a first internal cavity and an inner wall;

a first plurality of magnets coupled to the first housing and positioned proximate the inner wall in circumferentially spaced-apart relation;

a second housing positioned in the first internal cavity and having a second internal cavity and an outer wall;

a second plurality of magnets coupled to the second housing and positioned proximate the outer wall in circumferentially spaced-apart relation, the second magnet interacting with the first magnet to maintain a gap between the inner wall and the outer wall, the inner wall comprising a first plurality of facets and the outer wall comprises a second plurality of facets.

29. A thermal insulation vessel, comprising:

a first housing having a first internal cavity and an inner wall;

a first plurality of magnets coupled to the first housing and positioned proximate the inner wall in circumferentially spaced-apart relation;

a second housing positioned in the first internal cavity and having a second internal cavity and an outer wall;

a second plurality of magnets coupled to the second housing and positioned proximate the outer wall in circumferentially spaced-apart relation, the second magnet interacting with the first magnet to maintain a gap between the inner wall and the outer wall; and a first inductive coupling coupled to the second housing.

30. The thermal insulation vessel of claim 29, comprising a second inductive coupling coupled to the second housing.

31. A method of thermally insulating a first component from a second component that is positioned in the first component, comprising:

magnetically levitating the second component within the first component to eliminate physical contact between the first and second components; and providing the second component with a reflective outer surface, the reflective outer surface being provided by coating the component with a reflective material.

32. Apparatus for thermally insulating an electrical component, comprising:

a vessel;

a structure for supporting the electrical component, the structure being receivable within the vessel;

a system for levitating the structure within the vessel in a manner preventing physical contact between the structure and the vessel; and an electrical circuit structure coupled to the electrical component.

33. The apparatus of claim 32 wherein the electrical circuit structure includes an inductive coupling structure.

34. Apparatus comprising:

a component to be thermally insulated;

a vessel in which the component is received; and a system levitating the component within the vessel in a manner substantially preventing conductive heat transfer between the component and the vessel, the component being a battery.

35. A downhole tool assembly, comprising:

a downhole tool; and apparatus coupled to the downhole tool and including:

a vessel, a component disposed within the vessel, and a system levitating the component within the vessel.

36. The downhole tool assembly of claim 35 wherein the system includes:

a structure disposed within the vessel, carrying the component, and being levitated in a manner preventing physical contact between the structure and the vessel.

37. The downhole tool assembly of claim 36 wherein the structure is a housing within which the component is disposed.

38. The downhole tool assembly of claim 37 wherein at least one of the vessel and the housing is substantially evacuated.

39. The downhole tool assembly of claim 38 wherein each of the vessel and the housing is substantially evacuated.

40. The downhole tool assembly of claim 37 wherein the housing has a reflective outer surface.

41. The downhole tool assembly of claim 36 wherein the structure is magnetically levitated within the vessel.

42. The downhole tool assembly of claim 35 wherein the component is an electrical component.

43. A The downhole tool assembly of claim 42 wherein the component is a battery.

44. The downhole tool of claim 42 further comprising an inductive coupling structure operatively associated with the component.

45. The downhole tool assembly of claim 35 wherein the system magnetically levitates the component within the vessel.

46. A thermal insulation vessel comprising:

a first tubular housing formed from a nonmagnetic material and having a sidewall portion extending between closed opposite ends and having an inner side surface with a circumferentially spaced plurality of longitudinally extending depressions formed therein;

a second tubular housing formed from a nonmagnetic material and being adapted to receive an object to be thermally insulated, the second tubular housing being movably disposed within the first tubular housing in a longitudinally parallel relationship therewith and having a sidewall portion extending between closed opposite ends and having an outer side surface with a circumferentially spaced plurality of longitudinally extending depressions formed therein;

first and second pluralities of magnetic structures respectively carried in the depressions of the first and second tubular housings and magnetically maintaining between the first and second tubular housings a gap that laterally circumscribes the second tubular housing; and end magnetic structures disposed on the opposite ends of the first and second tubular housings and magnetically maintaining within the first tubular housing gaps between facing end portions of the first and second tubular housings.

47. The thermal insulation vessel of claim 46 wherein the interior of at least one of the first and second tubular housings is evacuated.

48. The thermal insulation vessel of claim 47 wherein the interiors of both the first and second tubular housings are evacuated.

49. The thermal insulation vessel of claim 46 further comprising a thermally conductive tubular heat transfer member coaxially positioned within the gap that laterally circumscribes the second tubular housing.

50. The thermal insulation vessel of claim 49 wherein the heat transfer member has a longitudinal thermal conductivity greater than its lateral thermal conductivity.

51. The thermal insulation vessel of claim 46 wherein:

the inner side surface of the first tubular housing and the outer side surface of the second tubular housing have circular shaped, and the first and second pluralities of magnetic structures have arcuate cross-sections.

52. The thermal insulation vessel of claim 46 wherein:

the inner side surface of the first tubular housing and the outer side surface of the second tubular housing have polygonal shaped defined by flat surface portions, the circumferentially spaced pluralities of depressions are disposed in the flat surface portions, and the first and second pluralities of magnetic structures have rectangular cross-sections.

53. The thermal insulation vessel of claim 46 wherein the first and second pluralities of magnetic structures are circumferentially offset from one another.

54. The thermal insulation vessel of claim 46 wherein the first and second pluralities of magnetic structures are circumferentially aligned with one another.

55. The thermal insulation vessel of claim 46 wherein the first and second pluralities of magnetic structures have like magnetic poles facing each other.

56. The thermal insulation vessel of claim 46 wherein the first and second pluralities of magnetic structures have opposite magnetic poles facing each other.

57. The thermal insulation vessel of claim 46 wherein first portions of the first and second pluralities of magnetic structures have like magnetic poles facing each other and second portions of the first and second pluralities of magnetic structures have opposite magnetic poles facing each other.

* * * * *